US008707589B2

(12) United States Patent
Hilton

(10) Patent No.: US 8,707,589 B2
(45) Date of Patent: Apr. 29, 2014

(54) EXCAVATOR BUCKET

(75) Inventor: Michael John Hilton, Aitkenvale (AU)

(73) Assignee: ESCO Engineering Pty. Ltd. (AU)

( * ) Notice: Subject to any disclaimer, the term of this patent is extended or adjusted under 35 U.S.C. 154(b) by 0 days.

(21) Appl. No.: 12/835,447

(22) Filed: Jul. 13, 2010

(65) Prior Publication Data

US 2011/0094130 A1 Apr. 28, 2011

(51) Int. Cl.
*E02F 3/40* (2006.01)

(52) U.S. Cl.
USPC ..... 37/444; 37/379; 37/465

(58) Field of Classification Search
USPC ..... 37/339, 341, 379, 398, 411, 443, 444, 37/465
See application file for complete search history.

(56) References Cited

U.S. PATENT DOCUMENTS

| | | | | | |
|---|---|---|---|---|---|
| 320,760 | A | * | 6/1885 | Clark | 37/465 |
| 333,637 | A | * | 1/1886 | Kennedy | 37/339 |
| 1,430,782 | A | * | 10/1922 | Attenborough et al. | 37/339 |
| 1,437,963 | A | * | 12/1922 | Dyke | 37/465 |
| 1,519,777 | A | * | 12/1924 | Ferris et al. | 37/339 |
| 1,795,982 | A | * | 3/1931 | Warner | 198/712 |
| 1,872,865 | A | * | 8/1932 | Young | 37/339 |
| 1,984,322 | A | * | 12/1934 | Stires | 37/339 |
| RE19,979 | E | * | 5/1936 | Bager | 37/444 |
| 2,090,563 | A | * | 8/1937 | Whisler | 37/339 |
| 2,113,420 | A | * | 4/1938 | Younie | 37/456 |
| 2,114,129 | A | * | 4/1938 | Younie | 37/339 |
| 2,126,522 | A | * | 8/1938 | Whittaker | 37/339 |
| 2,181,675 | A | * | 11/1939 | Watson | 37/339 |
| 2,211,997 | A | * | 8/1940 | Young | 37/339 |
| 2,228,546 | A | * | 1/1941 | Whisler | 37/339 |
| 2,330,409 | A | * | 9/1943 | Crouch | 37/339 |
| 2,525,528 | A | * | 10/1950 | Deal | 37/398 |
| 2,763,945 | A | * | 9/1956 | MacKenzie | 37/339 |
| 2,972,425 | A | * | 2/1961 | Anderson et al. | 37/379 |
| 3,408,755 | A | * | 11/1968 | Vikstrom | 37/444 |
| 4,037,337 | A | * | 7/1977 | Hemphill | 37/444 |
| 4,314,789 | A | * | 2/1982 | Luigi | 414/694 |
| 4,476,641 | A | * | 10/1984 | Ballinger | 37/444 |
| 4,570,365 | A | * | 2/1986 | Bierwith | 37/450 |
| 4,719,711 | A | * | 1/1988 | Sieber et al. | 37/444 |
| 5,283,965 | A | * | 2/1994 | Clendenning | 37/455 |
| 7,698,839 | B1 | * | 4/2010 | Phillips et al. | 37/444 |
| 7,832,128 | B2 | * | 11/2010 | Doucette et al. | 37/444 |
| 2008/0010870 | A1 | * | 1/2008 | Horton | 37/444 |
| 2010/0115801 | A1 | * | 5/2010 | Doucette et al. | 37/443 |

FOREIGN PATENT DOCUMENTS

| | | | |
|---|---|---|---|
| AU | 2004237824 | A1 | 6/2005 |
| GB | 1027232 | | 4/1966 |
| JP | 2001303607 | A | 10/2001 |
| JP | 2002309611 | A | 10/2002 |
| WO | WO 2007006116 | A1 | 1/2007 |

* cited by examiner

*Primary Examiner* — Jamie L McGowan
(74) *Attorney, Agent, or Firm* — Steven P. Schad

(57) ABSTRACT

An excavator bucket including containment portion and associated attachment means in order to attach the bucket to a piece of earthmoving equipment, the containment portion defined by a base wall, an opposed top wall, and a pair of opposed sidewalls located between the base wall and top wall, each of these walls having a forward edge together defining an opening to the containment portion, and a rear wall wherein the base wall, top wall and each side wall taper rearwardly to the rear wall.

26 Claims, 10 Drawing Sheets

EXCAVATOR BUCKET

FIELD OF THE INVENTION

The present invention relates to earthmoving equipment and particularly to buckets for excavators used to lift and load material.

BACKGROUND ART

Excavator buckets are known and there are a variety of configurations available on the market today.

Improvements in excavator buckets are directed at improving daily production in terms of the amount of material moved, and/or to reduce the wear and tear on implements with an overall intent to reduce costs and increase the dollars earned per unit of material moved.

Some examples of prior art excavator buckets are illustrated in FIGS. 1-7.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to an excavator bucket, which may at least partially overcome at least one of the abovementioned disadvantages or provide the consumer with a useful or commercial choice.

With the foregoing in view, the present invention in one form, resides broadly in an excavator bucket having a containment portion and associated attachment means in order to attach the bucket to a piece of earthmoving equipment, the containment portion defined by a base wall, an opposed top wall, and a pair of opposed sidewalls located between the base wall and top wall, each of these walls having a forward edge together defining an opening to the containment portion, and a rear wall wherein the base wall, top wall and each side wall taper rearwardly to the rear wall.

The excavator bucket of the present invention may be attached to any type of earthmoving equipment. For example, the excavator buckets illustrated in FIGS. 8-11 of the specification are designed to be attached to a conventional excavator with an articulated arm. However, it is to be appreciated that buckets according to the present invention may be manufactured and used in association with front-end loaders, these buckets being wider than the buckets illustrated, or other pieces of earthmoving equipment with appropriate modifications which will be well within the scope of knowledge of a person skilled in the art.

The bucket of the present invention will have associated attachment means in order to attach the bucket to a piece of earthmoving equipment. The attachment means will typically take the form of a pair of attachment flanges with one or more openings in each flange. The attachment flanges will normally be securely attached to the top wall of the bucket, but may extend rearwardly at least partially over the rear wall. The form of the attachment flanges is not essential to the invention.

The forward or leading edge of the base wall is typically referred to as the spade edge. The spade edge is normally associated with one or more digging teeth, however it can be configured as simply an edge, without any teeth provided. The digging teeth are normally securely but removably attached relative to the spade edge in order that they may be secured to use, but removable for replacement as they are a higher wear item.

The spade edge of the bucket of the present invention will preferably be arcuate with a central portion extending further forwardly than portions adjacent sidewalls of the bucket. The digging teeth are preferably oriented substantially perpendicular to that portion of the spade edge from which they extend. Alternatively, the digging teeth located towards the centre of the spade edge may be oriented forwardly, substantially perpendicular to the plane of the opening with the outer digging teeth on each lateral side of the bucket diverging outwardly.

The containment portion of the bucket may be defined by a base wall, an opposed top wall, and a pair of opposed sidewalls located between the base wall and top wall, and a dome shaped rear wall.

Each of the base wall, top wall, and sidewalls have a forward edge which together define an opening to the containment portion. Typically, the forward edges of the base wall (the spade edge) and the sidewalls will bear the majority of the load when material is picked up by the bucket. The spade edge and three edges of the respective sidewalls will generally be wedge shaped in order to function as cutting edges if the need arises.

The base wall, top wall and each side wall may taper rearwardly to the rear wall. The rear wall of the bucket of the present invention may have any shape, but is preferably dome-shaped. The interior surface of all of the walls will preferably have smooth junctions with little or no discernible join line or join edges as commonly found on conventional buckets.

Normally, the base wall will be substantially planar as will the top wall and each side wall. Each of these walls may be manufactured of more than one component attached together, or maybe a substantially unitary component. Preferably, the joins between the walls will be arcuate in order to minimise any well-defined joins. In providing joins of this nature, the base wall, top wall and sidewalls may together define a partially conical cavity, tapering toward each other as the walls extend away from the forward opening of the bucket. Further, the profile of the containment portion may be different on the inside to that of the outside shape of the bucket.

In addition, where the walls meet the dome shaped rear wall, any joins between these components will typically be arcuate, preferably self supporting, as well. As well as minimising the areas where material may become clogged, self-supporting arcuate joins are typically much stronger than simply joining to substantially planar walls at a given angle with a weld line.

The forward edges of any one or more of the walls may be appropriately reinforced or provided with wear resistant facing or components as may the digging teeth.

The rear wall of the bucket of the present invention may be curved to any degree, for example it may be hemispherical or torispherical. Due to the lack of angled joins, there are preferably fewer points of weakness in the bucket of the present invention and also reduced areas where material may become clogged.

The excavator bucket of the present invention has a significantly different shape to that of conventional buckets from the back of the spade lip and the initial side wall cutting edge.

The shape of the spade edge and the angle of the digging teeth has been slightly changed in fitment and angle to the spade edge and side walls of the bucket which allows for an improved penetration into the earth.

This shape has benefits, such as for example maintaining the forward edge of the side walls square to the lip of the bucket but only allowing a portion of the leading side wall edge to come in contact with the material being loaded and none of the side wall proper contacting the earth which significantly decreases the drag of the bucket through the loading material and allows for greater penetration and filling ability as the material is rolled into the bucket not forced into the bucket.

This method of filling the bucket may increase cycle times of the excavator and decrease wear on the bucket side walls and floor which may translate into more material moved in a day at less cost.

This design will also preferably have the ability to decrease the hang up of moist clay-type materials as the tapered shape reduces the areas in which this type of material sticks to any welded or square joins as it does with a conventional straight wall to floor bucket. It may also limit any "suction" type forces produced.

In field trials, with a bucket of the present invention compared to a conventional style bucket, tests were carried out with very heavy wet type clay material and the results were that this material ejected and flowed freely from the bucket of the present invention. Further only parts of the spade edge and a small portion of the leading edge held minimal material. With the conventional bucket, the material was locked in and extremely hard to dislodge.

The cubic capacity of a bucket will typically determine where the inner and outer wall of the bucket will take on a different shape.

ADVANTAGES for certain disclosed embodiments may include:

- Less tare weight due to bucket being a smaller capacity and less wear package to protect the side walls and bottom underside of the floor.
- Aggressive spade lip and teeth angle for penetration and loading.
- Smaller capacity for the same payload.
- Stronger due to tapered shape.
- Less drag on the bucket in material when being loaded with only minimal parts of the bucket coming into contact with material.
- fewer wearing parts equates to less daily cost and rebuild cost.
- Less hydraulic energy needed of the excavator to load the bucket which increases the life on expensive major hydraulic components, pumps, cylinders and the like.
- Less fuel burnt per hour for the excavator which lowers overall running costs and increases engine life hours.
- Minimal hang up in the bucket in heavy moist clays.
- All materials load faster and flow out of the bucket faster which increases cycle times which in turn, increases the amount of material moved per day at a lower unit cost.

All of the above would increase BCM* of materials moved in a given period for less cost and improve the ends user's bottom line profits.

*BCM=Bank Cubic meters, a measure of in-situ volume.

BRIEF DESCRIPTION OF THE DRAWINGS

Various embodiments of the invention will be described with reference to the following drawings, in which:

FIG. 6 is a perspective view of a prior art excavator bucket for a front-end loader or similar.

DETAILED DESCRIPTION OF THE PREFERRED EMBODIMENT

Figure 1:
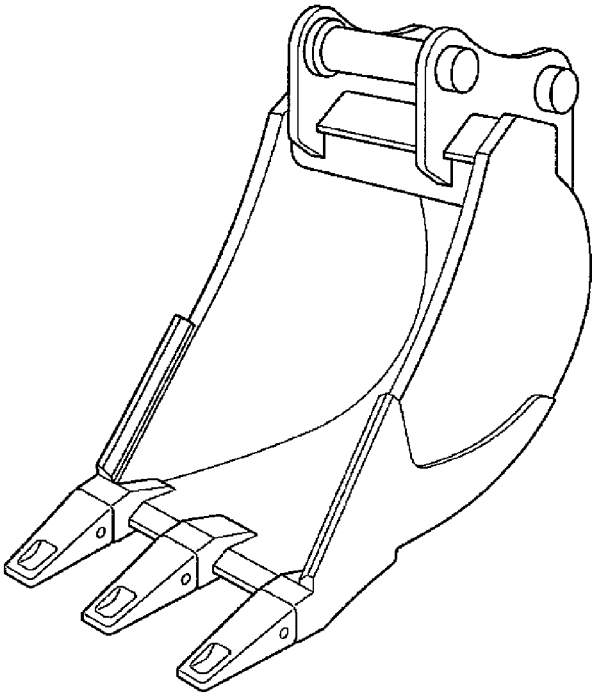
Figure 1 (Prior Art)
FIG. 1 is a perspective view from the front of a prior art excavator bucket.
Figure 2:
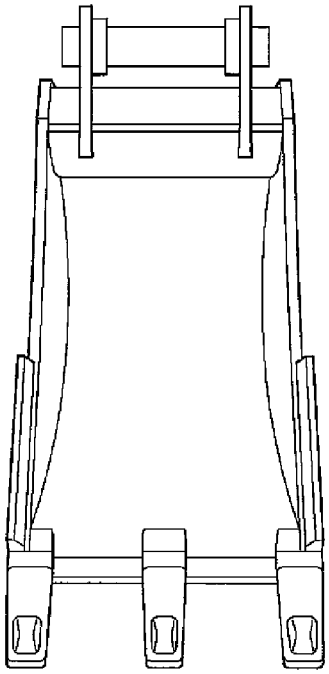
Figure 2 (Prior Art)
FIG. 2 is an elevation view from the front of the bucket illustrated in FIG. 1.
Figure 3:
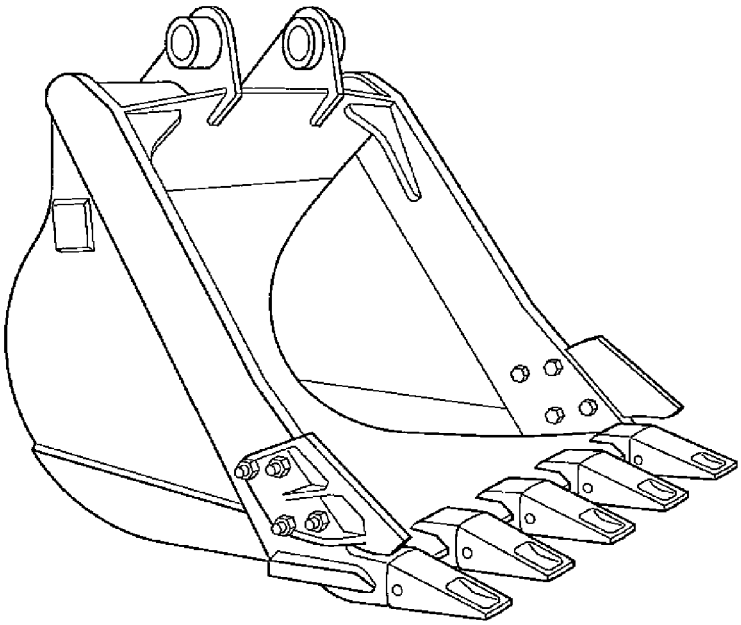
Figure 3 (Prior Art)
FIG. 3 is a perspective view of another prior art excavator bucket.
Figure 4:
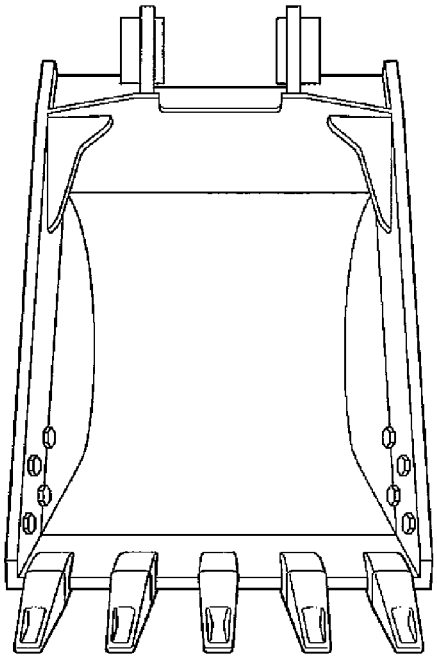
Figure 4 (Prior Art)
FIG. 4 is an elevation view from the front of yet another prior art excavator bucket.
Figure 5:
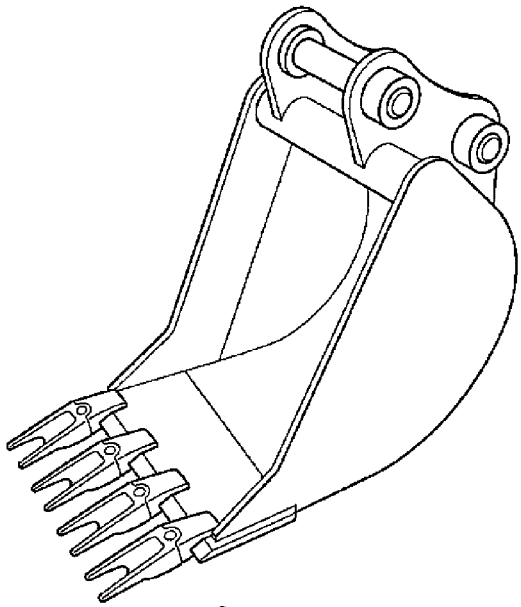
Figure 5 (Prior Art)
FIG. 5 is a perspective view of still another prior art excavator bucket.
Figure 6:
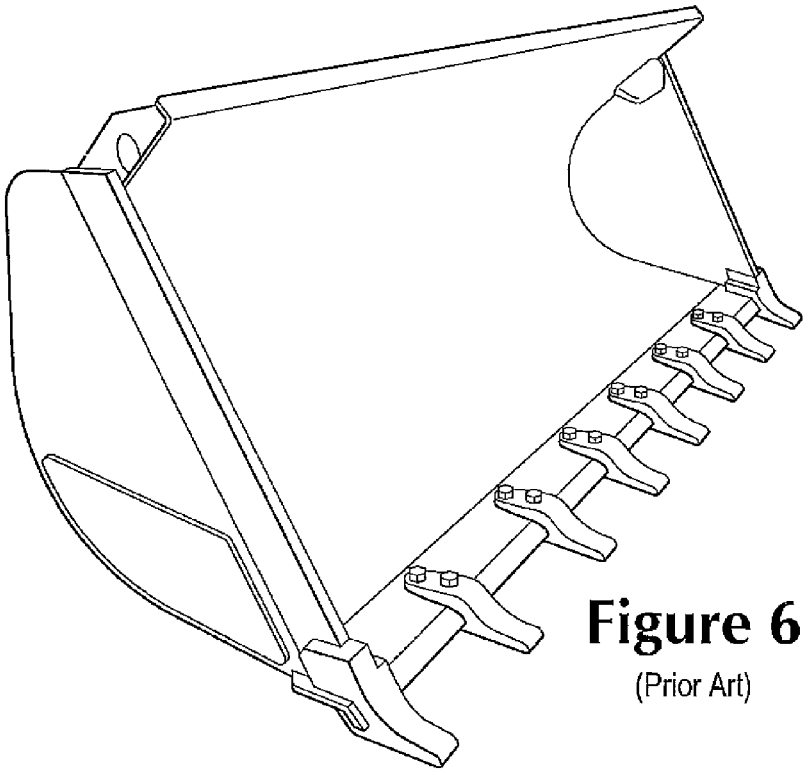
Figure 6 (Prior Art)
Figure 7:
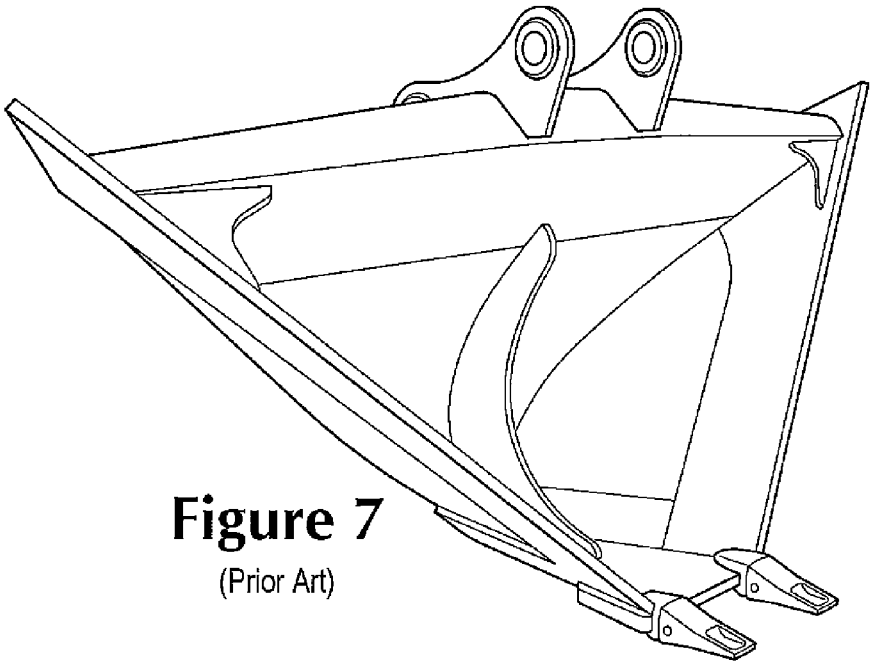
Figure 7 (Prior Art)
FIG. 7 is a perspective view of a prior art excavator bucket specifically designed to dig a V-shaped trench.
Figure 8:
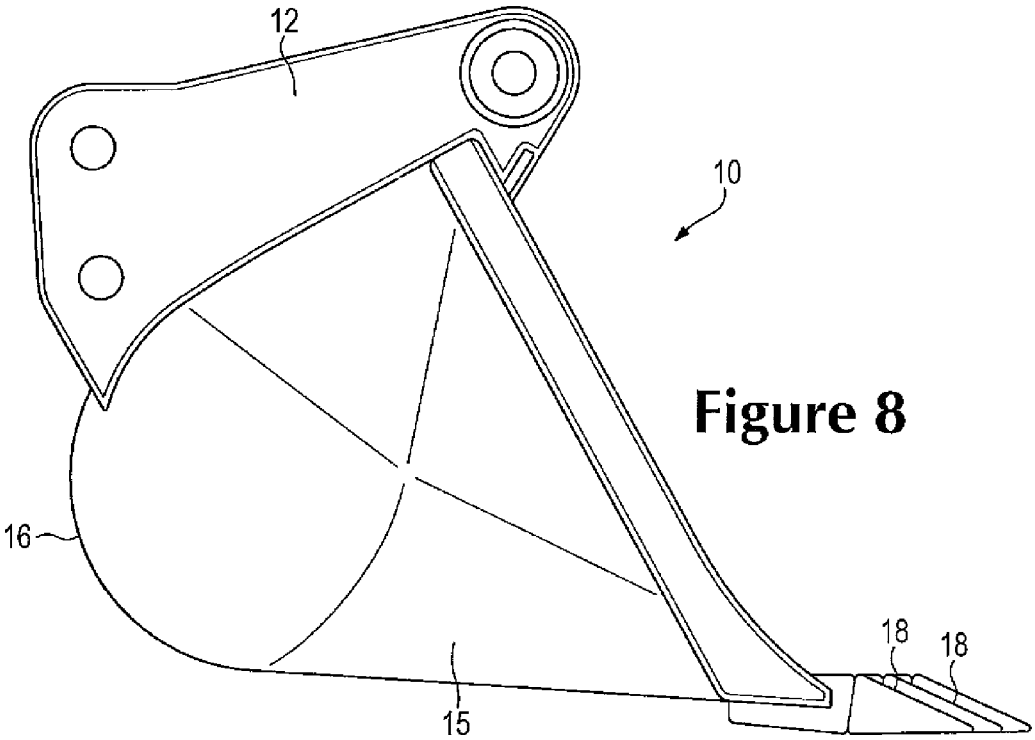
FIG. 8 is an elevation view from side of an excavator bucket according to a preferred embodiment of the present invention.
Figure 9:
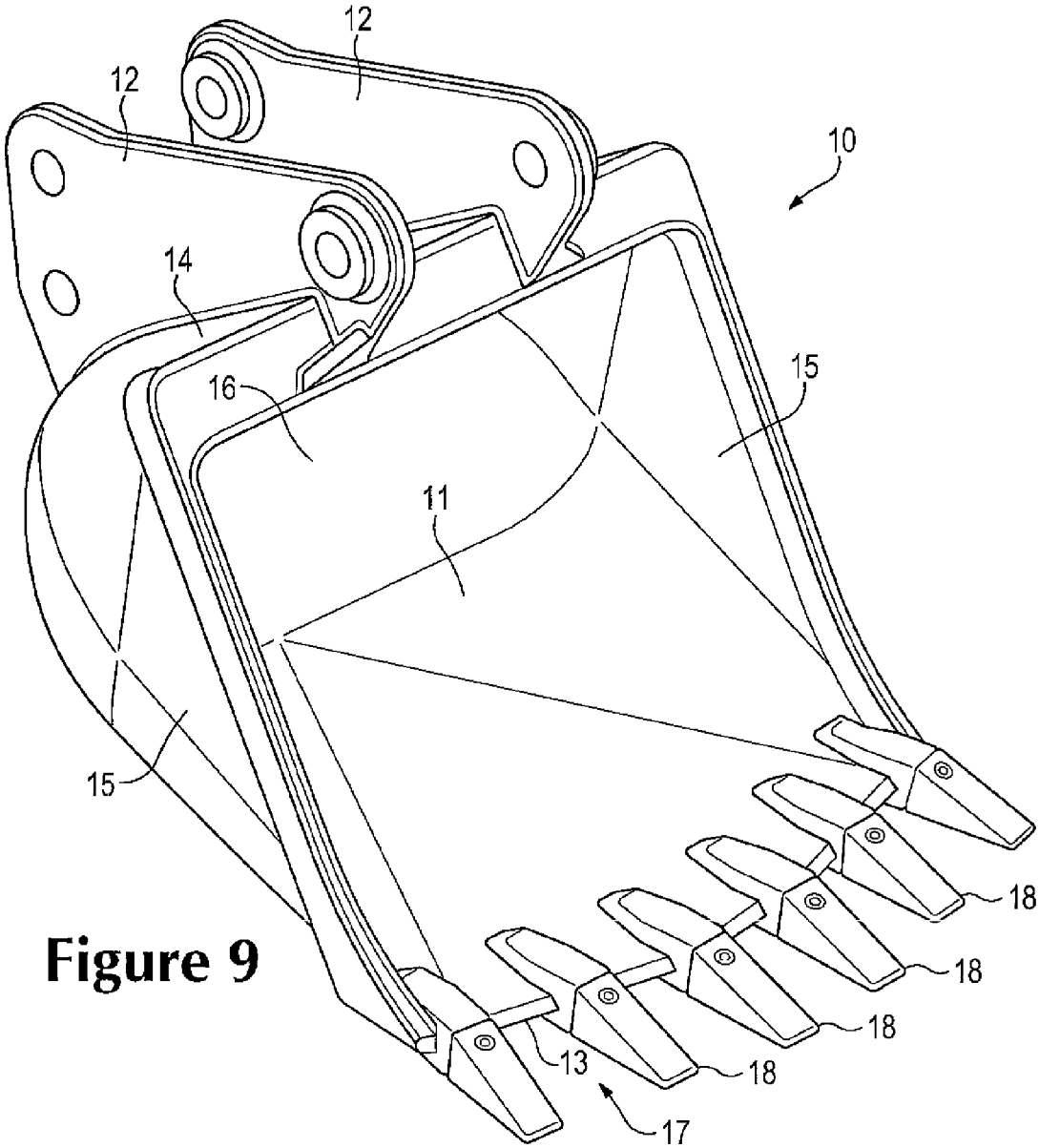
FIG. 9 is a perspective view of the excavator bucket illustrated in FIG. 8.

According to a particularly preferred embodiment, an excavator bucket 10 is provided.

The preferred form of excavator bucket 20 illustrated in FIGS. 8 to 11 has a containment portion 11 and associated attachment flanges 12 in order to attach the bucket 10 to a piece of earthmoving equipment (not shown). The containment portion 11 is defined by a base wall 13, an opposed top wall 14, and a pair of opposed sidewalls 15 located between the base wall 13 and top wall 14, each of the walls having a forward edge together defining an opening to the containment portion 11. According to the illustrated embodiment, a dome-shaped rear wall 16 is provided and the base wall 13, top wall 14 and each side wall 15 taper rearwardly to the rear wall 16.

The excavator bucket 10 illustrated in FIGS. 8-11 of the specification is designed to be attached to a conventional excavator with an articulated arm. As illustrated, the attachment flanges 12 are securely attached to the top wall 14 of the bucket, and extend rearwardly at least partially over the rear wall 16. The attachment flanges 12 each have three openings to attach the bucket to the excavator arm and top provide lever points to articulate the bucket 10.

The forward edge of the base wall 13 is normally referred to as the spade edge 17. The spade edge 17 of the illustrated embodiment (and generally when discussing buckets) is provided with one or more digging teeth 18. The digging teeth 18 are securely but removably attached relative to the spade edge 17.

Figure 10:
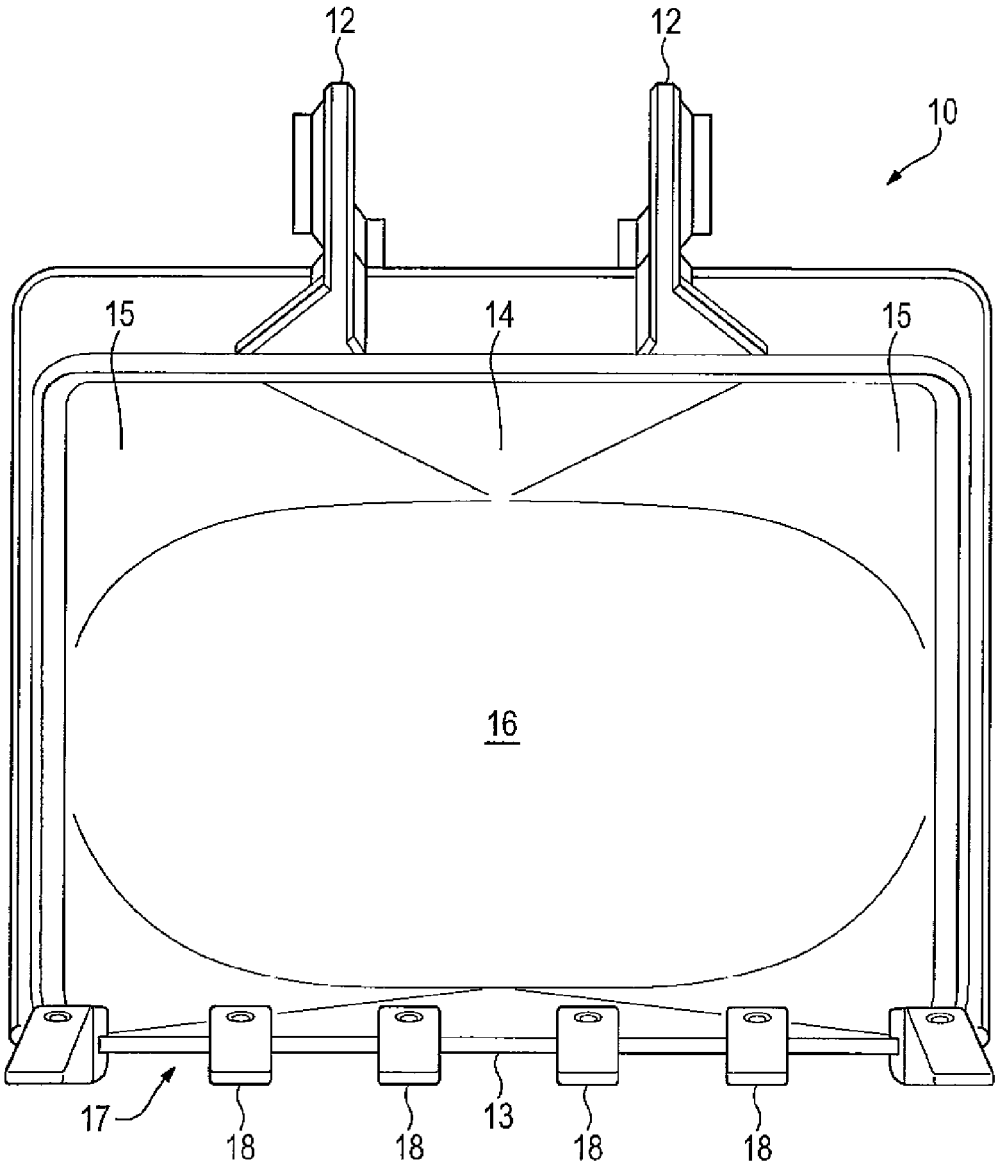
FIG. 10 is an elevation view from the front of the excavator bucket illustrated in FIGS. 8 and 9.
Figure 11:
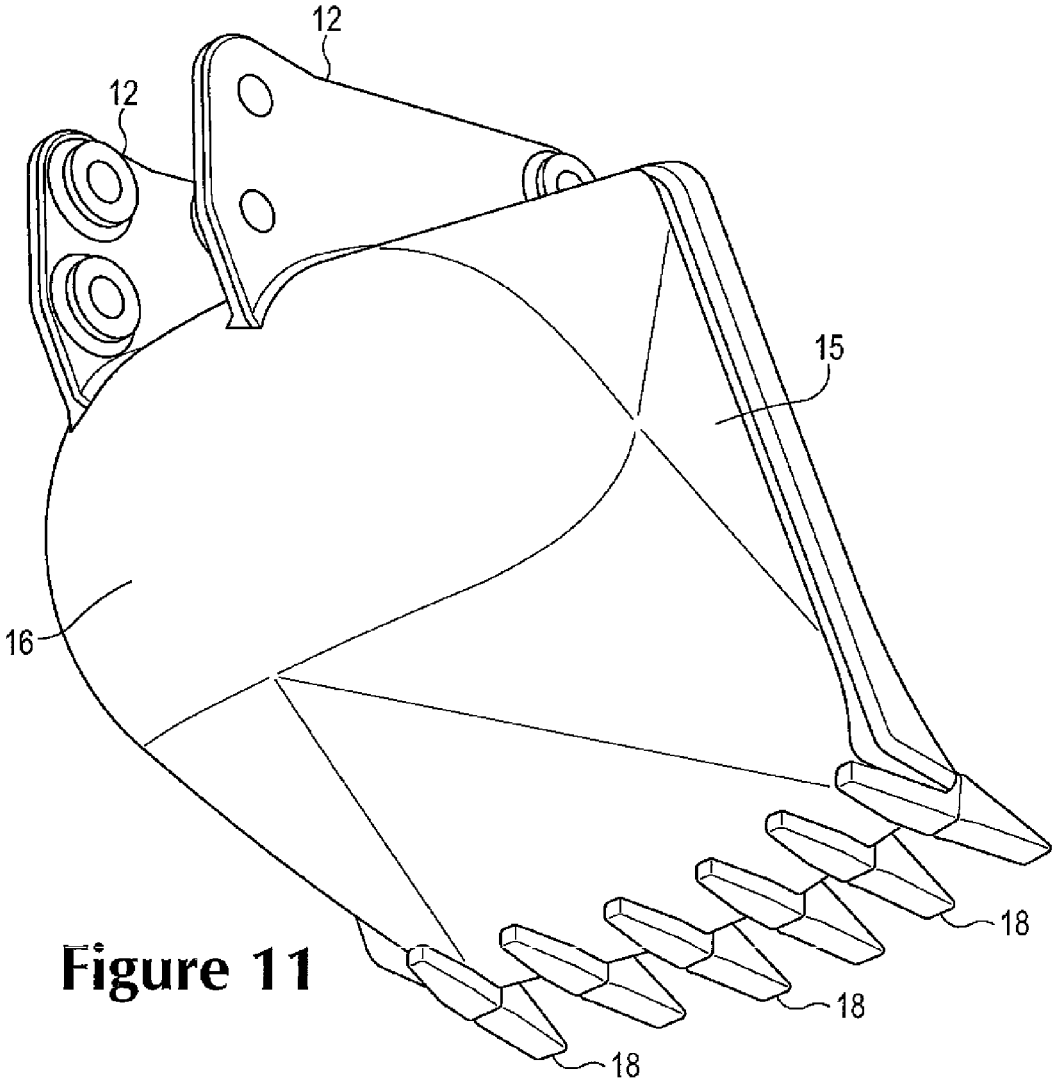
FIG. 11 is a perspective view from behind of the excavator bucket illustrated in FIGS. 8-10.

The spade edge 17 of the bucket 10 of the preferred embodiment is arcuate with a central portion extending further forwardly than portions adjacent sidewalls of the bucket, as illustrated in FIG. 10 in particular. The digging teeth 18 are oriented forwardly of the spade edge in the central potion of the spade edge and the outermost digging tooth on each lateral side of the spade edge 17 is oriented forwardly and outwardly.

The base wall 13, top wall 14 and each side wall 15 taper rearwardly to the rear wall 16. The rear wall 16 of the bucket 10 of the illustrated embodiment is dome shaped and the interior surface of all of the walls have smooth junctions with little or no discernible join lines or join edges as can be seen from FIG. 10.

The joins between the walls are arcuate in order to minimise any well-defined joins. In providing joins of this nature, the base wall 13, top wall 14 and sidewalls 15 together define a partially conical cavity, tapering toward each other as the walls extend away from the forward opening of the bucket.

In addition, where the walls meet the dome shaped rear wall 16, any joins between these components are arcuate as well. As well as minimising the areas where material can become clogged, self-supporting arcuate joins such as are used in the preferred embodiment are typically much stronger than simply joining to substantially planar walls at a given angle with a weld line.

This bucket shape has many benefits, maintaining the forward edge of the side walls square to the lip of the bucket but only allowing a portion of the leading side wall edge to come in contact with the material being loaded and none of the side wall proper contacting the earth which significantly decreases the drag of the bucket through the loading material and allows for greater penetration and filling ability as the material is rolled into the bucket not forced into the bucket.

This method of filling the bucket will typically increase cycle times of the excavator and decrease wear on the bucket side walls and floor which will relate to more material moved in a day at less cost.

The bucket illustrated in FIGS. 8-11 decreases the hang up of moist clay-type materials as the tapered shape reduces the areas in which this type of material sticks to any welded or square joins as it does with a conventional straight wall to floor bucket. It will also limit any "suction" type forces produced.

In field trials, with the bucket illustrated in FIGS. 8-11 compared to a conventional style bucket, tests were carried out with very heavy wet type clay material and the results were that this material ejected and flowed freely from the bucket of the present invention. Further, only parts of the spade edge and a small portion of the leading edge held minimal material. With the conventional bucket, the material was locked in and extremely hard to dislodge.

Figure 12:
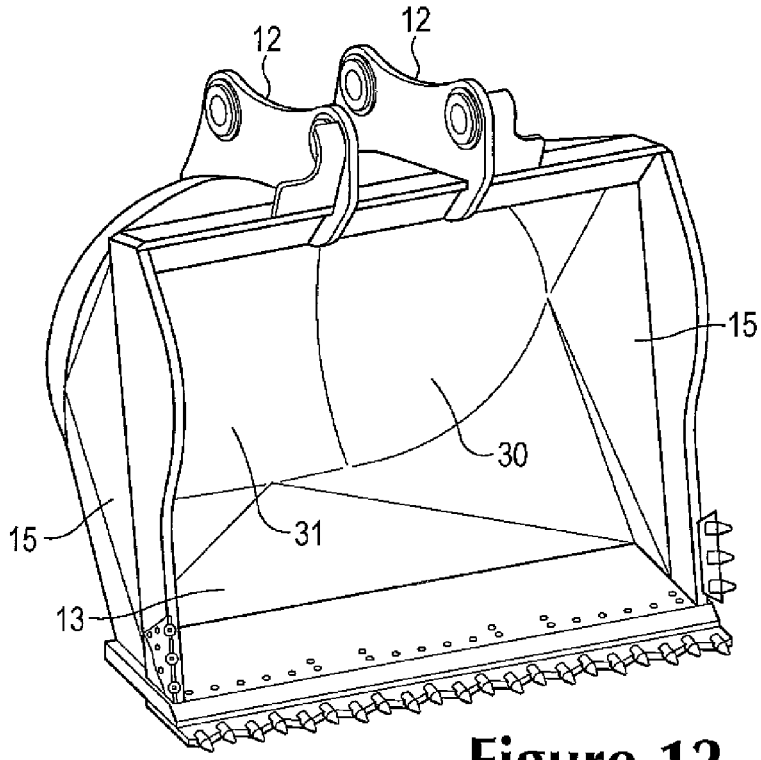
FIG. 12 is an isometric view from the front of an excavator bucket of the present invention according to an alternative embodiment.
Figure 13:
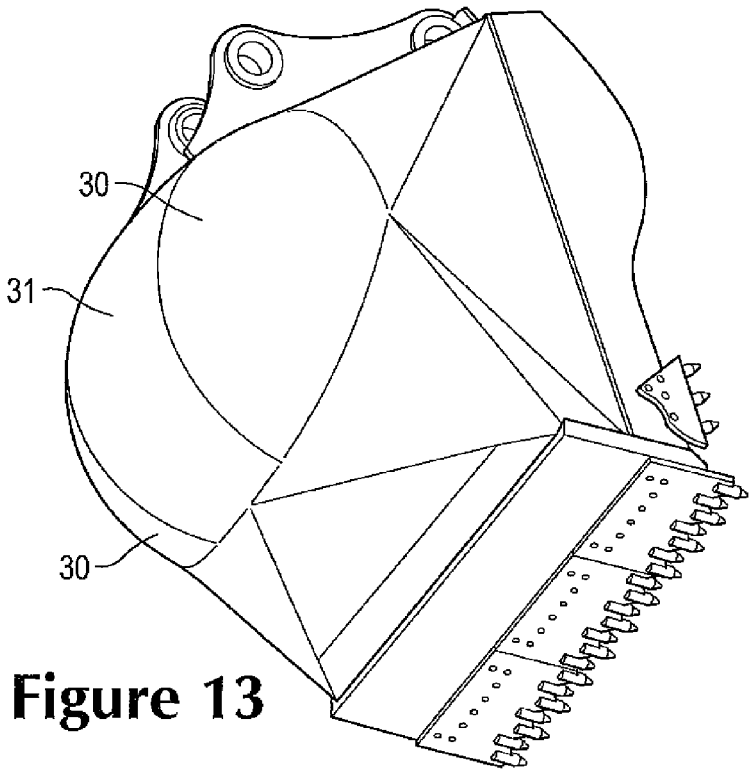
FIG. 13 is an isometric view from below and behind of the excavator bucket illustrated in FIG. 12.
Figure 14:
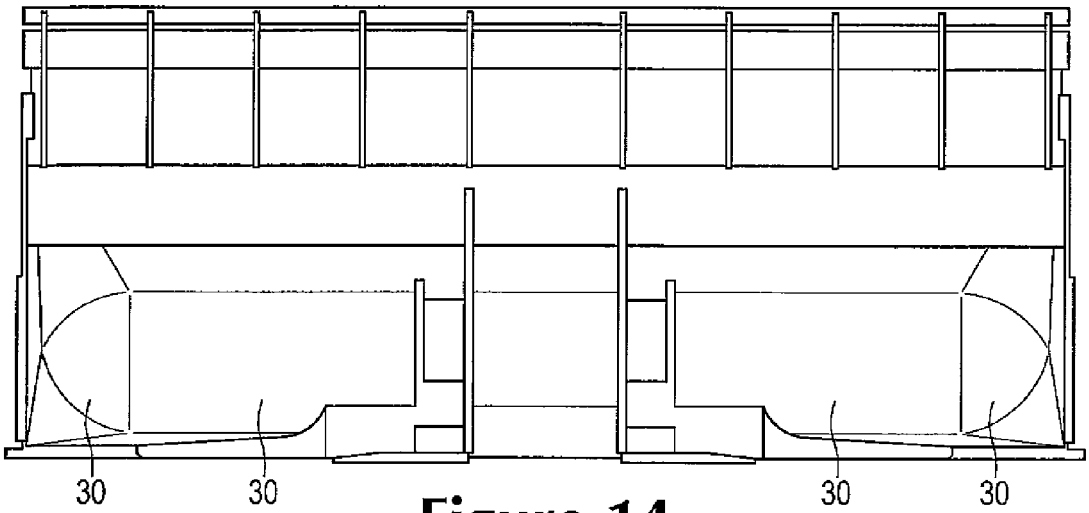
FIG. 14 is a view from above of an excavator bucket of the present invention according to still a further alternative embodiment.
Figure 15:
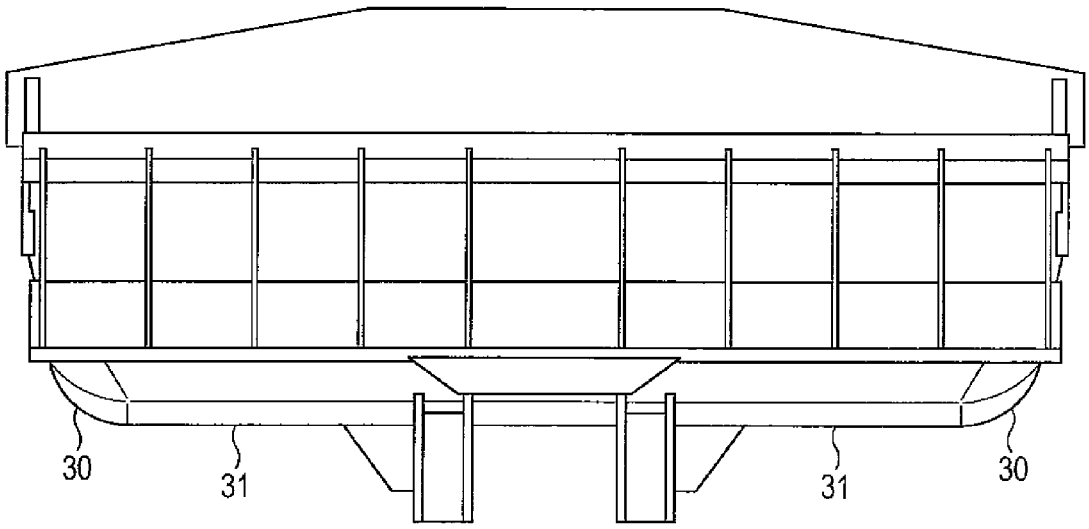
FIG. 15 is a view from below of the excavator bucket illustrated in FIG. 14.
Figure 16:
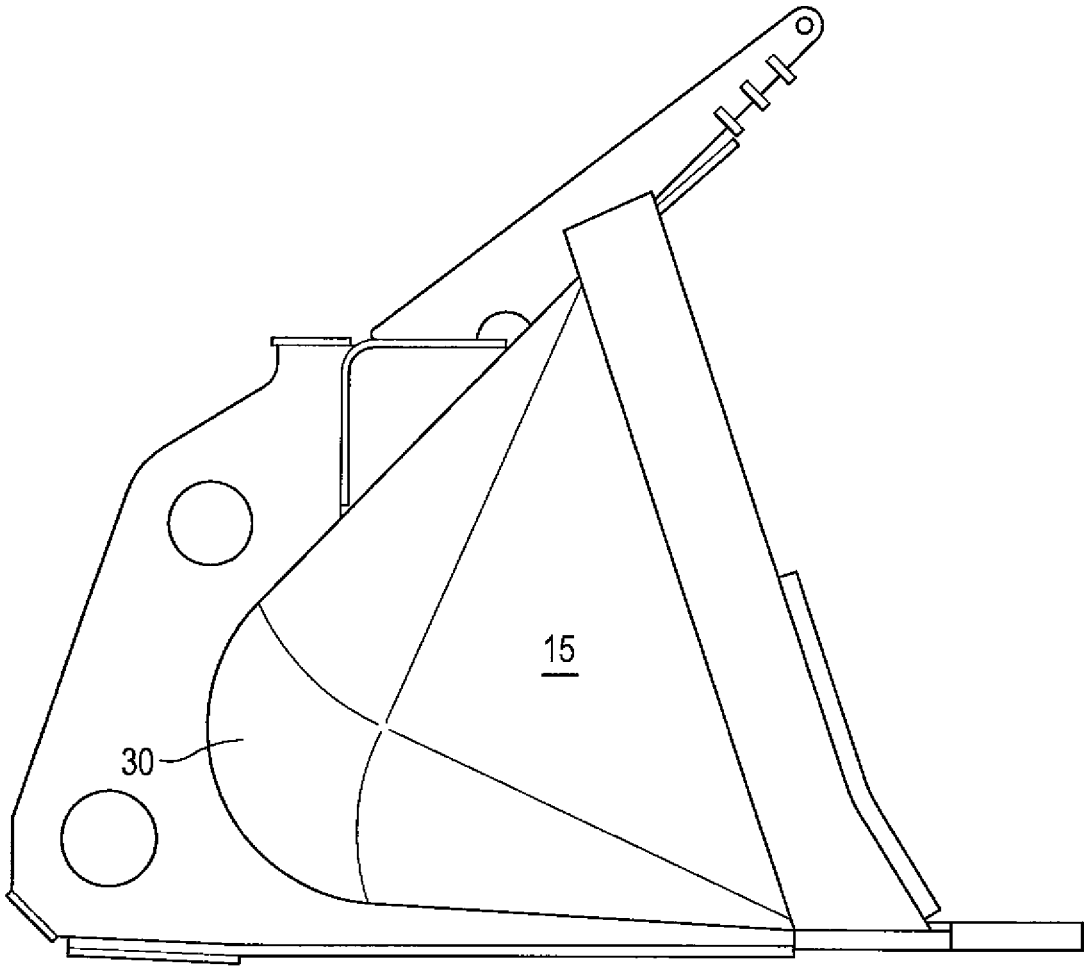
FIG. 16 is a view from the side of the excavator bucket illustrated in FIGS. 14 and 15.
Figure 17:
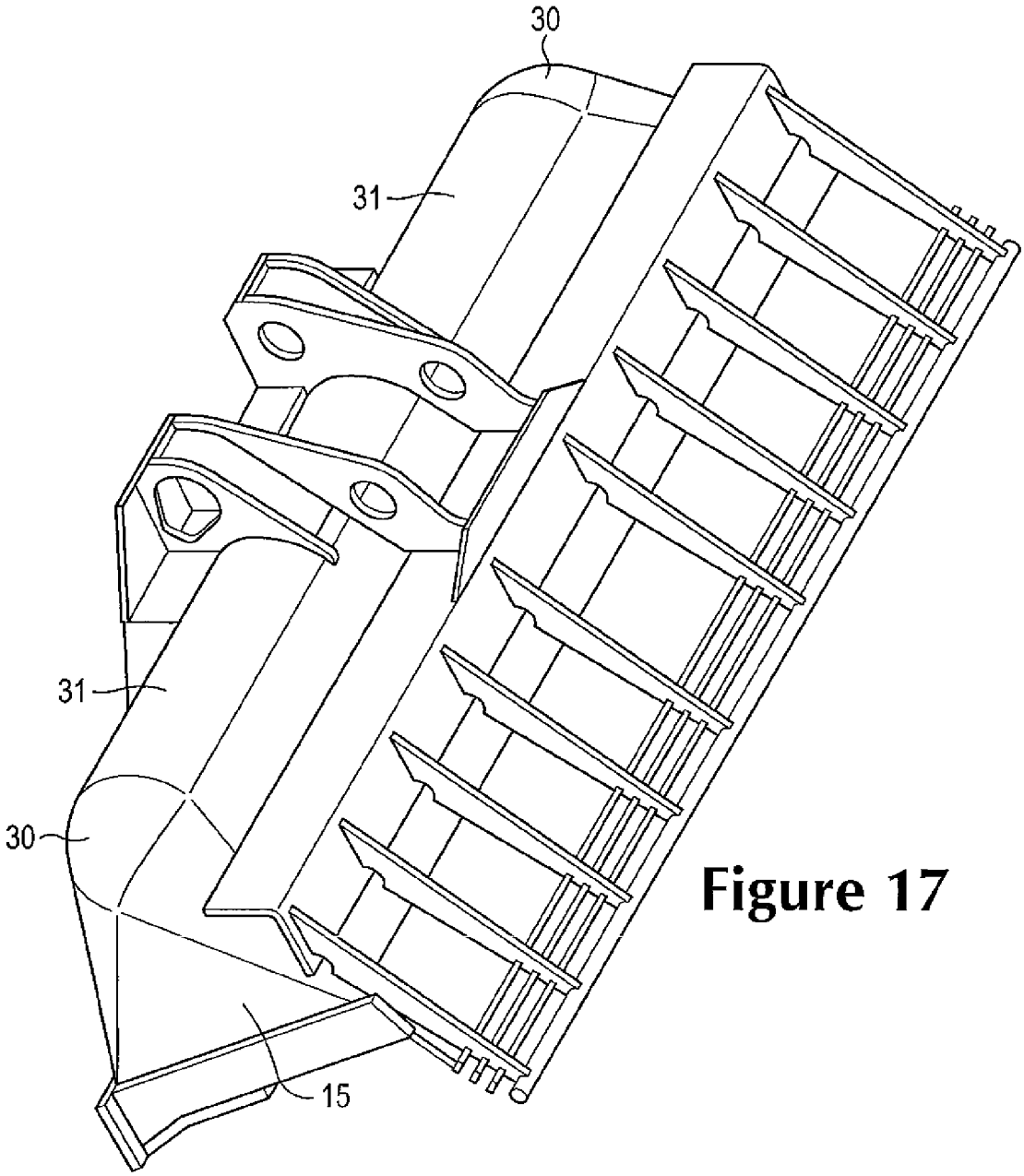
FIG. 17 is a view from above and behind of the excavator bucket illustrated in FIGS. 14-16.

An alternative embodiment of the excavator bucket of the present invention is illustrated in FIGS. 12 and 13. According to this embodiment, the rear wall of the bucket has two partially spherical portions 30 with a partially cylindrical portion 31 located between them. According to this form of invention, the dome-shaped rear wall of eth first embodiment has been replaced by a partially spherical/partially cylindrical rear wall. The front edge has also supplied with alternative teeth.

A further alternative embodiment of the excavator bucket of the present invention is illustrated in FIGS. 14 to 17. According to this embodiment, the rear wall of the bucket again has two partially spherical portions 30 with a partially cylindrical portion 31 located between them. According to this embodiment, the partially cylindrical portion 31 is of greater dimension, that is length, than the embodiment illustrated in FIGS. 12 and 13. The principles of the invention however remain the same.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An excavator bucket comprising a containment portion to gather the material to be excavated and an attachment support to attach the bucket to earthmoving equipment, the containment portion defined by a base wall, an opposed top wall, and a pair of opposed sidewalls located between the base wall and the top wall, each of these walls having a forward edge together defining an opening to the containment portion, and a rear wall, wherein the base wall, the top wall and each of the side walls taper rearwardly to the rear wall, and the rear wall has an interior surface that curves in at least two dimensions.

2. An excavator bucket according to claim 1 wherein the attachment support includes a plurality of attachment flanges with at least an opening in each flange.

3. An excavator bucket according to claim 2 wherein the flanges are securely attached to the top wall of the bucket, extending rearwardly and extending substantially perpendicularly to the top wall.

4. An excavator bucket according to claim 1 wherein a forward edge of the base wall is arcuate with a central portion extending further forwardly than portions adjacent sidewalls of the bucket and multiple digging teeth are provided oriented substantially perpendicular to the portion of the forward edge from which they extend.

5. An excavator bucket according to claim 1 provided with multiple digging teeth attached to and projecting forward of the forward edge of the base wall.

6. An excavator bucket according to claim 1 wherein all of the walls that adjoin have smooth junctions between them.

7. An excavator bucket according to claim 1 wherein any joins between the walls of the bucket are arcuate.

8. An excavator bucket according to claim 1 wherein the rear wall is dome shaped, hemispherical or torispherical.

9. An excavator bucket according to claim 1 wherein the forward edge of the side walls is substantially perpendicular to the forward edge of the base wall.

10. An excavator bucket including a containment portion and associated attachment means in order to attach the bucket to a piece of earthmoving equipment, the containment portion defined by a base wall, an opposed top wall, and a pair of opposed sidewalls located between the base wall and top wall, each of these walls being substantially planar and having a forward edge together defining an opening to the containment portion, and a rear wall wherein the base wall, top wall and each side wall taper rearwardly to the rear wall, all of the walls being formed from separate panels, the bucket also including an arcuate transition formed from one or more additional panels provided between at least the side walls and the rear wall.

11. An excavator bucket according to claim 10 wherein an arcuate transition is provided between the top wall and the rear wall.

12. An excavator bucket according to claim 10 wherein an arcuate transition is provided between the bottom wall and the rear wall.

13. An excavator bucket according to claim 10 wherein an arcuate corner is provided between the top wall, the side wall and the base wall on each side of the bucket.

14. An excavator bucket according to claim 13 wherein the rear wall is arcuate between the arcuate corners.

15. An excavator bucket according to claim 14 wherein the arcuate rear wall is arcuate about a substantially horizontal axis.

16. An excavator bucket according to claim 13 wherein the arcuate corner is at least partially dome shaped, hemispherical or torispherical linking the top wall, the side wall and the base wall.

17. An excavator bucket according to claim 16 wherein the arcuate corner links the rear wall to the top wall, the side wall and the base wall.

18. An excavator bucket according to claim 13 wherein the rear wall is dome shaped, hemispherical or torispherical.

19. An excavator bucket comprising a containment portion to gather the material to be excavated and an attachment support to attach the bucket to earthmoving equipment, the containment portion having a containment surface defined by a base surface, an opposed top surface, a pair of opposed side surfaces located between the base surface and top surface, and a rear surface, wherein the containment portion is formed by separate parts joined together, and the containment surface has smooth junctions between the surfaces that adjoin.

20. An excavator bucket according to claim 19 wherein the top surface and the side surfaces are joined together by arcuate transitions that diverge toward the rear surface.

21. An excavator bucket according to claim 20 wherein the side surfaces and the base surface are joined together by arcuate transitions that diverge toward the rear surface.

22. An excavator bucket according to claim 20 wherein the arcuate transition is provided at a forward portion of the bucket.

23. An excavator bucket comprising a containment portion to gather the material to be excavated and an attachment support to attach the bucket to earthmoving equipment, the containment portion has a containment surface defined by a base surface, an opposed top surface, a pair of opposed side surfaces located between the base surface and top surface, and a rear surface, wherein the containment portion is formed by separate parts joined together, and the side surfaces and the rear surface are joined together by arcuate transitions.

24. An excavator bucket according to claim 23 wherein the side surfaces and the top surface are joined together by arcuate transitions.

25. An excavator bucket according to claim 24 wherein the side surfaces and the base surface are joined together by arcuate transitions.

26. An excavator bucket according to claim 23 wherein the top surface and the base surface are each joined to the rear surface by arcuate transitions.

* * * * *